United States Patent [19]

Esser

[11] Patent Number: 4,471,714

[45] Date of Patent: Sep. 18, 1984

[54] DEVICE FOR THE REGULATION OF THE APPLICATION WEIGHT OF COATINGS ON MATERIAL CARRIED AS A RUNNING WEB

[75] Inventor: Reiner Esser, Bergisch Gladbach, Fed. Rep. of Germany

[73] Assignee: J. M. Voith GmbH, Heidenheim, Fed. Rep. of Germany

[21] Appl. No.: 400,720

[22] Filed: Jul. 22, 1982

[30] Foreign Application Priority Data

Jul. 24, 1981 [DE] Fed. Rep. of Germany ..... 3129251

[51] Int. Cl.[3] ..... B05C 11/04

[52] U.S. Cl. ..... 118/126; 118/249

[58] Field of Search ..... 118/126, 123, 413, 410, 118/249

[56] References Cited

U.S. PATENT DOCUMENTS 3,285,225 11/1966 Recor ..... 118/410
3,996,889 12/1976 Otten et al. ..... 118/126
4,279,949 7/1981 Esser ..... 118/126 X
4,375,202 3/1983 Miller ..... 118/126 X

FOREIGN PATENT DOCUMENTS 1652273 5/1970 Fed. Rep. of Germany .
1905567 8/1970 Fed. Rep. of Germany .
2822682 11/1979 Fed. Rep. of Germany .

*Primary Examiner*—John P. McIntosh
*Attorney, Agent, or Firm*—Keil & Weinkauf

[57] ABSTRACT

A device for the regulation of the wet application weight of coated webs, the web being supported on its uncoated side by a roll. The device has a stationary, inherently rigid wiping device with a concavely curved long entrance flank so that between web surface and wiping device a sickle-shaped entrance gap is formed. The radius of curvature of the entrance flank of the wiping device is equal to or only slightly greater or smaller than that of the support roll. In order to avoid wear and tear at the edge of the wiping device additional wear elements are provided at the wiping device.

5 Claims, 4 Drawing Figures

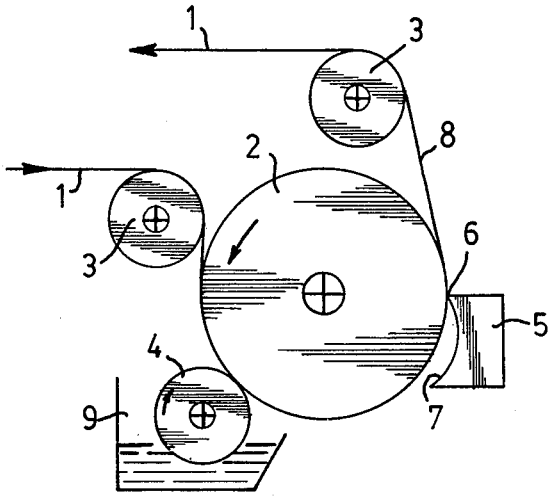
Fig. 1
Fig. 2
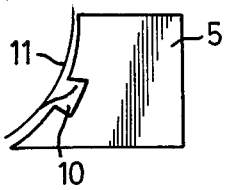
Fig. 3
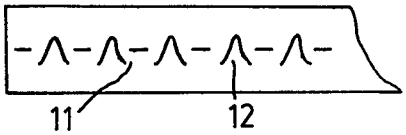
Fig. 4
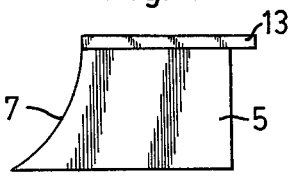

DEVICE FOR THE REGULATION OF THE APPLICATION WEIGHT OF COATINGS ON MATERIAL CARRIED AS A RUNNING WEB

BACKGROUND OF THE INVENTION

The invention relates to a device for the control of the wet application weight of coatings on material webs, in particular of conventional pigment dispersions on paper or carton webs.

In order to improve the printability of paper surfaces and to adapt the paper to particular printing processes, such paper surfaces are coated with pigment/bonding agent dispersions. Depending on the intended application the dry coating weights lie between 5 and 35 grams per square meter. The coating is conventionally carried out by means of aqueous dispersions with varying contents of drying substances so that the wet application weights are considerably higher. It has proved to be advisable to first apply an excess of coating material to the running web of material and to subsequently remove this excess from the surface by means of metering devices, whereby a smoothing of the coating surface likewise is an objective. Among the known metering devices are roll-type application arrangements using metering rolls, so-called reverse roll coaters, scraping roll metering devices, also known as rakels, and smoothing-and-scraping devices which are briefly known as blades.

In the metering process the coated web of material is carried by a supporting device, for example a roll, and a pressure is exerted on the web by the metering assembly, for example the blade or rakel which pressure opposes the coating mass.

In U.S. Pat. No. 2,051,403 there is described a coating arrangement the essential feature of which resides in the design of the wiping device. This especially formed, curved wiping device exhibits in the course of its curvature two different radii. The end of the entrance flank is not a sharp edge but it is rounded since sharp edges are said to lead to a faulty surface and to unsatisfactory results. The adjoining entrance flank is convexly curved and has a larger radius than the radius of curvature of the rounded edge.

In U.S. Pat. No. 2,534,320 a wiping device with a blade thickness of between 3 and 12 mm has been described the entrance flank of which ends in a sharp edge, with the radius of curvature of the entrance flank approximately corresponding to the radius of curvature, of 150 mm, of the roll supporting the web, this roll having an elastic surface. The curvature is convex in this design. The scraper is mounted in a rotatable support and it can be urged against the web surface with a varying pressure so that the surface of the supporting roll is deformed.

In U.S. Pat. No. 1,925,092 there is described a wiping device which is directed against a freely carried web, the web being carried, for a short length, around the curved entrance flank of the wiping device up to the sharp edged end of the latter. The wiping device simultaneously serves as a web guiding and deflecting element. The gap thus formed is bounded by the convexly curved surface of the wiping device and the concavely curved coated surface of the web. Since the outgoing web leaves the sharp edge of the wiping device tangentially, adjustment of a well-defined entrance gap is not possible. The geometry of the entrance gap formed in this manner depends not only on the web velocity but also on the quantity and the rheological properties of the coating mass as well as on the stretching properties of the paper web. The gap geometry, therefore, is not only defined by the device but it is dependent on the process conditions which exist at any given time and is thus more or less undefined and not controllable.

In principle this is true also for the known metering device using a doctor blade and a material web which is supported by a roll.

Depending on the magnitude of the pressure and the position of the metering device relatively to the surface of the coated material web, a layer of greater or lesser thickness remains on the material web. Doctor blades and also rakel rods are, taken by themselves, not sufficiently stable tools for the setting of a gap geometry and in addition they require mountings and guides which lend to them the required linearity, bending strength and resistance against the hydrodynamic counter-pressure of the coated mass. Particularly high requirements apply to the design of such mountings. With the web widths of several meters and with the web velocities of up to 1200 mm per minute which are common today the requirements can be met by a corresponding constructive design merely to a certain degree. As a result, the known metering devices are unsatisfactory particularly when, for the achievement of high application weights, the known doctor blades are laid against the web with a small setting angle and low application pressure. Under these conditions there is formed a wiping area or zone over which the wiping device engages the web surface. This leads, very soon, to a condition in which blade forces, partially can no longer withstand the higher coating pressure and in which a differing application weight is produced cross-wise of the web. Even small deviations form linearity, due to manufacturing tolerances or other causes lead to considerable variations in the application quantities cross-wise of the web following metering. Attempts have been made to improve the linearity by supporting, for example the doctor blade, by means of pressure hoses. These results are unsatisfactory especially in the case of larger web widths.

The coating systems possible and conventional today may exhibit operating widths of up to 6000 mm. The operating velocities and the application weights greatly depend on the paper types and the desired properties. For LWC (light weight coated) paper they range up to 1300 meters per minute with application weights of up to 10 grams per square meter and side; for cartons, for example, to 250 meters per minute with application weights of approximately 30 grams per square meter for each side, and for so-called art printing paper up to 600 meters per minute with application weights of approximately 25 grams per square meter and side.

In the course of systematic investigations it has been found that the gap geometry is of considerable significance and that it is desirable, therefore, to design this gap geometry in a well-defined way, and to control in this fashion the hydrodynamic pressure in the entire entrance gap.

OBJECT AND SUMMARY OF THE INVENTION

Accordingly, it is the object of the invention to create a wiping device, or scraping device, which makes is possible to set the wet application weight on coated webs with great accuracy, namely by controlling the hydrodynamic pressure of the coating mass between the running web and the stationary wiping device.

This problem is solved by means of a device for the regulation of the application weight of coatings on material in the form of a running web, particularly a paper or carton web with a roll supporting the running web on the uncoated side, the roller having a radius of 150 to 500 mm and an elastic surface with a hardness of 82 to 34 Shore A units, and a wiping device which is stationary while acting on the coating and which on its entrance side has a curved entrance flank, the end of which engaging the material web is of sharp-edged design, and the wiping device being rockable about the point of engagement of the material web as the pivot point. The characteristic of the solution according to the invention resides in that the wiping device which is rigid in itself has a concavely curved entrance flank with a radius of curvature which is equal to or only slightly smaller or greater than the radius of curvature of the supporting roll and that the length of the entrance flank is from 10 to 250 mm.

Preferred embodiments of the device are described in the subclaims.

The advantage of the design of the metering device consists in that the geometry of the entrance gap between supporting roll and wiping device is fixed for each setting angle of the wiping device and that at the end of the entrance gap there is a narrow line of engagement, and that no zone of engagement of the wiping device is formed if the latter is applied to the web with a pressure sufficient to compensate the hydrodynamic pressure of the coating. Therefore, the gap geometry, apart from the setting angle, is independent of the process conditions which exist in metering at any given time.

BRIEF DESCRIPTION OF THE DRAWING

The invention is described hereinbelow in detail with reference to schematic section drawings and further illustrations.

FIG. 1 shows, in section, an arrangement and design of a metering device according to the invention, with a coating system;

FIG. 2 shows, in section, schematically the combination of the wiper block with an inserted steel leaf;

FIG. 3 shows schematically the arrangement of stamped out tabs in the insertable steel leaf;

FIG. 4 shows in section, an embodiment of the wiping device with a superimposed end strip.

DESCRIPTION OF THE PREFERRED EMBODIMENTS

In FIG. 1 a web of material, for example a paper or carton web 1 is supplied, by way of a deflecting roll 3 to a supporting roll 2; it encircles the latter, is taken off via a further deflecting roll 3, and it arrives in following portions of the coating system, for example a dryer not shown. With the aid of a conventional, known application device 4 with a trough 9 for the coating mass, an excess in coating mass is applied to the web and is removed from web 1 by means of wiping device 5. The wiped-off coating mass is collected in a catching tub not shown. Behind wiping device 5 there remains on web 1 the set coating thickness 8. Wiping device 5 engages the web surface at point 6. Supporting roll 2, wiping device 5 and application device 4 which is only schematically shown by way of example, are mounted in a stable frame which contains the required operating equipment for application device 4 and support roll 2. The engagement of the web surface by wiping device 5 at point 6 is achieved by bearing means in the frame provided on both sides of wiping device 5. The bearing means are designed so that the wiping device can be rocked about the point of engagement 6 as the pivot point, in order to make the accurate setting of the entrance gap between web surface and concavely curved entrance flank 7 of the wiping device possible. The equipment required for the exact and reproducible setting of wiping device 5 is mounted in or on the frame. The desired application pressure on the web carried on the supporting roll is produced mechanically, hydraulically or pneumatically, by way of the ends, on both sides, of wiping device 5. Such means are known. In practice, pneumatic arrangements have proved to be better than mechanical or hydraulic ones, and they are thus preferred in the application of the device according to the invention. By applying wiping device 5 to the web with the end 6 of the entrance flank 7, and by the selection of a flat setting angle the entrance flank 7 is made to progressively approach coated web 1, which is carried by supporting roll 2, over a longer stretch and a sickle-shaped entrance gap is formed the geometry of which is determined by the radius of curvature of supporting roll 2 and entrance flank 7 of the wiping device and by the setting angle. Due to the concave curvature on the one hand a slow narrowing of the wedge-shaped gap is achieved and on the other hand the formation of a larger engagement surface at the gap end is prevented; such a surface is formed, necessarily, in the case of a doctor blade and a flat setting angle. This gap geometry is determined by the device, is settable in a reproducible manner and is independent of process conditions like operating velocity, rheological properties and quantity of the coating mass on the paper web, etc. By giving wiping device 5, by means of a corresponding cross-section, a design which is rigid in itself, a uniform engagement of the roll by the wiping device over the entire web width is insured even for greater operating widths. The exact cross-section of wiping device 5 is not critical; important is that it has a concavely curved entrance flank 7 of corresponding length and a sharp-edged end 6. Preferred is a cuniform or rectangular cross-section. The wiping device may be solid or it may be formed with a hollow profile. The wall thickness of the hollow profile and its size are dimensioned, as in the case of full material, so that for a given operating width, wiping device 5, is rigid in itself and buckling in the web center is avoided. The length of the entrance flank may be 10 to 250 mm, preferably 25 to 230 mm, particularly 50 to 200 mm or 80 to 150 mm. For larger diameters of the supporting roll greater lengths of the entrance flanks are favorable. With increasing operating width larger flank lengths also are beneficial, so as to achieve a rigid design of wiping device 5. If necessary, additional stiffening elements may be provided in order to render the wiping device rigid in itself. The wiping device consists of a durable material of sufficient mechanical strength, for example steel or coated metal alloys or a correspondingly stable plastic material.

The radius of supporting roll 2 is 150 to 500 mm, depending on the operating width; as a rule, larger operating widths require larger radii in order to avoid buckling. Support roll 2 has a hard core with an elastic covering. Suitable for this purpose are synthetic types of rubber or synthetic polymers with the necessary elasticity. The surface hardness of the support roll may be determined by various measuring methods. Conventional are plastometers according to Pussey and Johnes (P+J=units measured with the ⅛-inch ball) or shore-hardness apparatus (Shore A, measured by means of a truncated cone). The surface hardness of the support roll should be between 82 and 34 Shore A units (=40 to 197 P+J units). Preferred are 56 to 41 Shore A units (=108 to 160 P+J units). Especially suited is a surface hardness of 40 to 44 Shore A units (=127 to 149 P+J).

Because of the formation of a narrow sickle-shaped wedge gap of corresponding length a very high hydrodynamic coating pressure is built up in the entrance gap, which requires correspondingly high counterpressures, that is application pressures of wiping device 5 against the web surface at engagement point 6. In order to hold the required application pressures of wiping device 5 within reasonable limits, the setting angle of the wiping device for desired low coating weights is increased so that the initial width of the entrance gap is increased and the pressure buildup in the sickle gap takes place over a shorter range. In order to obtain a high pressure buildup in the gap for high coating weights and thus facilitate correspondingly high application pressures, a flat setting angle, that is a narrow long sickle gap selected. Between web surface and pressed-on wiping device 5 a hydrodynamic pressure is built up in the coating mass which produces a slide-bearing effect. That is, wiping device 5 virtually floats on the coating mass and carries out a sort of premetering. The wiping surface proper at the end of the entrance flank is extremely narrow, almost line-shaped. This engagement zone determines the final metering of the coating weight and leads to the final smoothing of the coating surface. The high hydrodynamic pressures resulting from this setting of the wiping device require, even for high coating weights, that is, dry coating weights between 15 and 30 grams per square meter—the wet coating weights, depending on the content of drying substance of the coating mass, are correspondingly higher—considerable application pressures of the wiping device and thus an exact setting is possible. Due to the inherently rigid design of the wiping device, a partial yielding of the metering assembly is not possible.

FIG. 2 shows an embodiment of the wiping device 5 wherein there is inserted into the entrance flank 7 a steel leaf 11 which may be replaced when needed. In this manner inaccuracies due to wear and tear of the wiping edge 6 proper at the end of entrance flank 7 can be avoided. Microscopic investigations of this edge have shown that grinding-in in analogy to the known doctor blades is not required but the normal sharp edge furnishes the best results. It is, however, also possible to use correspondingly ground blades. The steel leaf is inserted into the concavely curved entrance flank so that its edge terminates in the wiping edge 6. However, it is also possible to insert the steel leaf in such a fashion that it extends slightly, for example by 1 to 10 mm, beyond the edge of the wiping device in order to lengthen the entrance flank. In this case the wiping device is made to engage the web surface with the end of the inserted steel leaf and this line of engagement serves as the axis of rotation for the wiping device. The leaf 11, preferably made of spring steel, which is inserted into the entrance flank 7 is to contact the wiping device 5 if possible over its entire surface and it is to be held in this position. According to an embodiment this may also be accomplished by providing the entrance flank 7 with an undercut groove 10 which is engaged by stamped-out lugs 12 of the steel leaf whereby the blade is kept laid-on under tension. However, other mounting and holding means, too, are useful as long as the leaf is held flat against the curved entrance flank 7 of wiping device 5.

FIG. 3 shows the arrangement in steel leaf 11, of the stamped-out tabs 12 whose centers are in spaced relationship to each other.

FIG. 4 shows a further embodiment of wiping device 5 in which as the element which is subjected to wear, an end strip 13 is mounted on the wiping device 5 which forms the terminating edge 6 of the wiping device 5. Since the wiping edge proper is very narrow, the end strip 13 may be made so thin that no grinding-in corresponding to the radius of curvature of the entrance flank 7 is required. It is sufficient and possible to use square bars of correspondingly wear-resistant material. Such materials are, for example, steel alloys, particularly hard steel alloys or other wear-resistant materials.

The operation of the device according to the invention will be described in further detail in the following example:

A corresponding coat raw paper with a weight of 75 grams per square meter is to be coated with (A) 10 grams per square meter or (B) 25 grams per square meter of a coating mass having the following composition:

100 parts of pigment (clay, chalk, satin white)
10 parts of adhesive, for example carboxylized styrene-butadiene-latex with 50 percent drying substance
4 parts of a soluble adhesive, for example casein
1 part of alkali lye, for example 25 percent NaOH 74 parts of water.

The coating furthermore contains the required parts of dispersion-promoting agents, defoamers and other conventional additives.

The coating system has the arrangement shown in FIG. 1. The web width is 315 cm. In accordance with FIG. 2, an inserted leaf of spring steel is used as the wiping device. The wiping device has a concavely curved entrance flank with a radius of curvature of 250 mm and it is 200 mm long. The support roll has a diameter of 500 mm, a surface hardness is 46 Shore A units (40 P+J units).

For a web velocity of 500 meters per minute there is first applied, by means of a conventional dip roll, an excess of coating material and this excess is removed again by the wiping device. For this purpose, the sharp edged end of the wiping device is applied to the coated web surface at a flat angle and with a pressure such that the hydrodynamic pressure of the coating material which is building up in the sickle-shaped entrance gap is compensated so that in operation a narrow gap is produced between the wiping edge and the surface of the support roll which the coated web passes with a set, well-defined coating thickness and smooth surface.

The low coating weight A of 10 grams per square meter is a quantity for the metering of which the known blade has proved to be particularly suited. This type of wiping device develops its advantages for a step setting angle of the blade and for high application pressures. A comparable effect is obtained with the device according to the invention if the setting angle is larger so that a short entrance zone is formed with pressure build-up in the coating. With an application pressure of approximately 3 kN per meter (line pressure), pneumatically produced and acting against the support roll at the two lateral ends of the wiping device in the frame, a wet application weight is obtained in the instant case which in dried condition (6 percent moisture content) amounts to 10 grams per square meter. The application weight was determined, as a check, in each case for equal web thickness at the outer edges and in the center of the web. The average values derived from several measurements yielded: outer edges of the web 10 grams per square meter and 10.1 grams per square meter, web center 10 grams per square meter. The maximum deviations of the individual measurements between each other were 0.5 grams per square meter. These values show the virtual constancy of the weight transversely of the web.

The higher coating weight B of 25 grams per square meter is a quantity for the metering of which a blade is less well suited, because of the required low setting angle and the low application pressure. Conventionally, other coating means are required in this case, for example a roller application system. Now, according to the invention, with the same metering device with which a low coating weight was obtained, also a higher coating weight is possible—by means of a flatter setting of the wiping device and the formation of a long sickle-shaped entrance gap in which a hydrodynamic pressure is produced in the coating mass—without the necessity of substantially lowering the application pressure. Due to the easy adjustability of the wiping device, only acceptable weight variations transversely of the web occur. The high quality requirements have greatly narrowed the tolerable range of the weight variations. For reasons of manufacturing economy, the operating widths of the systems have been constantly increased whereby in the conventional metering devices weight variations transversely of the web necessarily had to be put up with. This disadvantage is avoided by the invention. For an application pressure of approximately 3 kN per meter (line pressure) produced against the support roll at the lateral ends of the wiping device in the frame, in the instant case a wet coating is obtained which in dried condition (6 percent moisture content) amounts to 25 grams per square meter. The coating weight was determined, as a check, in each case for the same web thickness at the outer edges and in the web center. The average values from several measurements yielded:

outer edges of the web 25 grams per square meter and 24.5 grams per square meter, web center 24 grams per square meter.

The maximum deviations of the individual measurements were two grams per square meter. These values show a virtual constancy of the weight transversely of the web.

An essential advantage of the device according to the invention resides in that independent of the desired application weight, an application pressure can always be chosen which makes an exact formation of the gap transversely of the web possible also for larger operating widths. The condition for this is the proper elasticity of the support roll surface, which must make possible the formation of a sickle-shaped reproducibly adjustable entrance gap and a short wiping range proper at the engagement edge of the wiping device, and furthermore, the wiping device which is rigid in itself and has a concavely curved entrance flank. The application pressure should be as low as possible considering the design costs of the support roll and its bearings in the frame, however this pressure should be sufficiently high that at least the hydrodynamic pressure of the coating which, at today's web velocities of up to 1200 meters per minute, is building up, is compensated and that the adjustment is possible with sufficient reproducibility. A further advantage of the device according to the invention resides in that considerably different coating weights are possible with a single device, with less variations than heretofore conventional, particularly for high operating widths. At the same time qualities in surface and transparency of the coating are obtained that have been possible heretofore only with different metering devices that were especially adapted to high or low coating weights. The advantage of the wiping device which is rigid in itself and has a concavely curved, long entrance flank resides in that it cannot only be produced, without major difficulties, with the required accuracy but is also adjustable with high accuracy and reproducibility transversely of the web. The sickle-shaped gap, between support roll and wiping device, which, in operation is more or less widely filled with coating mass, is, particularly at the end edge of the wiping device, of equal thickness in each position transversely of the web and it yields lower departures from the nominal weight than has been possible heretofore with the known metering means.

LIST OF REFERENCE NUMERALS

1. Web of material, particularly carton or paper
2. Support roll with elastic surface
3. Deflecting rolls, guide rolls
4. Application device
5. Wiping device
6. Sharp-edged end of the entrance flank, application line, pivot axis
7. Curved entrance flank of the wiping device
8. Adjusted application thickness on the coated web
9. Open trough for the coating mass
10. Groove in wiping device
11. Inserted steel leaf, blade
12. Stamped-out tabs in steel leaf
13. Strip, end strip

I claim:

1. In an apparatus for coating material carried as a running web, said apparatus comprising:

a roll supporting the running web on its uncoated side, said roll having a radius of 150–500 mm and an elastic surface of 82–34 Shore A units, and a coating device for applying an excess amount of coating mass to said material, means including a separate scraping device, for removing excess of coating mass and thereby regulating the application weight of the coating, said scraping device being located downstream of said coating device, being stationary while acting on the coating and being inherently rigid so as to substantially not deform in response to the forces occurring in the operation of the device, having, on its entrance side a curved entrance flank whose end contacting the material web has a sharp edge, being rotatable about its point of engagement with the material web as a pivot point, and the entrance flank of said scraping device being concavely curved so as to define a substantially sickle-shaped gap for the admission of the coating mass between said entrance flank and the roll-supported running web, the ratius of curvature being equal to, or only slightly larger or smaller than, the radius of curvature of the support roll, and the length of the entrance flank being from 10 to 250 mm.

2. A scraping device according to claim 1, wherein the length of the entrance flank is 50–250 mm.

3. A scraping device according to claim 1 or 2, wherein into the concavely curved entrance flank of the scraping device there is inserted a steel leaf contacting said device, said steel leaf being mounted so as to be held flat against the curved entrance flank of the scraping device and so that its end terminates at a point adjacent said sharp edge of the scraping device.

4. A scraping device according to claim 3, wherein the entrance flank of said scraping device has an undercut groove and the steel leaf has mutually spaced, stamped out tabs engaging said grooves and holding said steel leaf in position.

5. A scraping device according to claim 1 or 2, wherein the end of the entrance flank forming said point of engagement is formed by an end strip mounted on the scraping device.

* * * * *